US007116207B1

(12) United States Patent
Yu

(10) Patent No.: US 7,116,207 B1
(45) Date of Patent: Oct. 3, 2006

(54) SAFETY DEVICE FOR SWITCHES

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 0 days.

(21) Appl. No.: 11/173,380

(22) Filed: Jul. 2, 2005

(51) Int. Cl.
*H01H 71/16* (2006.01)

(52) U.S. Cl. ..... 337/59; 337/89

(58) Field of Classification Search ..... 337/37, 337/59, 56, 64, 89, 91, 333, 334, 348; 200/553–559; 29/622

See application file for complete search history.

(56) References Cited

U.S. PATENT DOCUMENTS 3,733,571 A * 5/1973 Budlane et al. ..... 337/89
6,452,125 B1 * 9/2002 Yu ..... 200/553
6,456,185 B1 * 9/2002 Yu ..... 337/37
6,469,610 B1 * 10/2002 Chen ..... 337/66
6,884,955 B1 * 4/2005 Yu ..... 200/553
6,984,798 B1 * 1/2006 Lu ..... 200/334
7,030,726 B1 * 4/2006 Yu ..... 337/66

* cited by examiner

*Primary Examiner*—Lisa Lea-Edmonds
*Assistant Examiner*—Corey Broussard

(57) ABSTRACT

A switch includes a body and a switch member is pivotably engaged with the top opening of the body. A resilient member is connected between an inside of the body and a first end of the switch member. The switch member further has an extension extending from a second end of an underside thereof and a push member extends from the first end of the underside of the switch member. A bi-metallic contact plate has a first end fixed to one of two terminals and a contact portion splits from the contact plate and a first contact point is connected to an underside of the contact portion. A second contact point is connected to the other terminal. A free end of the contact portion is connected with a free fist end of a spring member that has an extension portion extending from a top thereof and a second end of the spring member is connected to the contact plate. The second end of the contact plate is deformed downward and the free end of the contact portion is deformed upward to separate the two contact point when overload. The resilient member pivots the switch member to "OFF" position after the circuit is overload.

6 Claims, 4 Drawing Sheets

(OFF)

(ON)

SAFETY DEVICE FOR SWITCHES

FIELD OF THE INVENTION

The present invention relates to a safety switch that ensures the bimetallic plate to be deformed as desired when overload.

BACKGROUND OF THE INVENTION

A conventional switch device, especially for those switches using bimetallic plate to prevent from being burn when an overload is happened, generally includes a bimetallic plate which is deformed when overload so as to separate the two contact points respectively located on the bimetallic plate and one of the two terminals. Some inherent shortcomings for these conventional safety switch devices are found. There are too many parts involved in the safety switch device and a longer period of time is required when assembling the switch device, this increases the cost of the products. The parts might be arranged inaccurately and affects the deformation of the bimetallic plate. Once the bimetallic plate is deformed to cut off the circuit, because of the improper arrangement of the parts as mentioned above, the bimetallic plate could deform to re-connect the two contact points to connect the circuit again. Because the inaccuracy of the deformation of the bimetallic plate, the switch member does not set the "OFF" position after the bimetallic plate is deformed to cut off the circuit.

Therefore, it is desired to have a safety device that allows the bimetallic plate to deform toward a desired direction and there is enough space to prevent the bimetallic plate from bouncing back to connect the circuit again.

SUMMARY OF THE INVENTION

In accordance with an aspect of the present invention, there is provided a switch device that comprises a body with a switch member pivotably engaged with the top opening of the body. A first terminal and a second terminal extend through a bottom of the body. A contact portion extends from an inside of the body. The switch member has an engaging hole and an extension slot is in communication with the engaging hole. A contact plate is a curve flexible metal plate and has a first end fixed to the first terminal and a first contact point is connected to an underside of a second end of the contact plate. A second contact point is located above the second terminal. The first contact point is located above the second contact point. A link has an upper end pivotably engaged with the engaging hole and a lower end of the link is connected to the second end of the contact plate. At least one biasing plate extends from a side of the link. When the switch device is in "ON" status, the at least one biasing plate is in contact with the contact portion to provide a potential force to allow the upper end of the link to move into the extension slot when overload.

The main object of the present invention is to provide a safety switch that provides a sufficient space for movement of the spring member so that the contact plate is deformed completely to cut off the circuit.

Another object of the present invention is to provide a safety switch wherein the switch member is pivoted to "OFF" position when overload.

Yet another object of the present invention is to provide a safety switch that includes less number of parts so as to have lower manufacturing cost.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
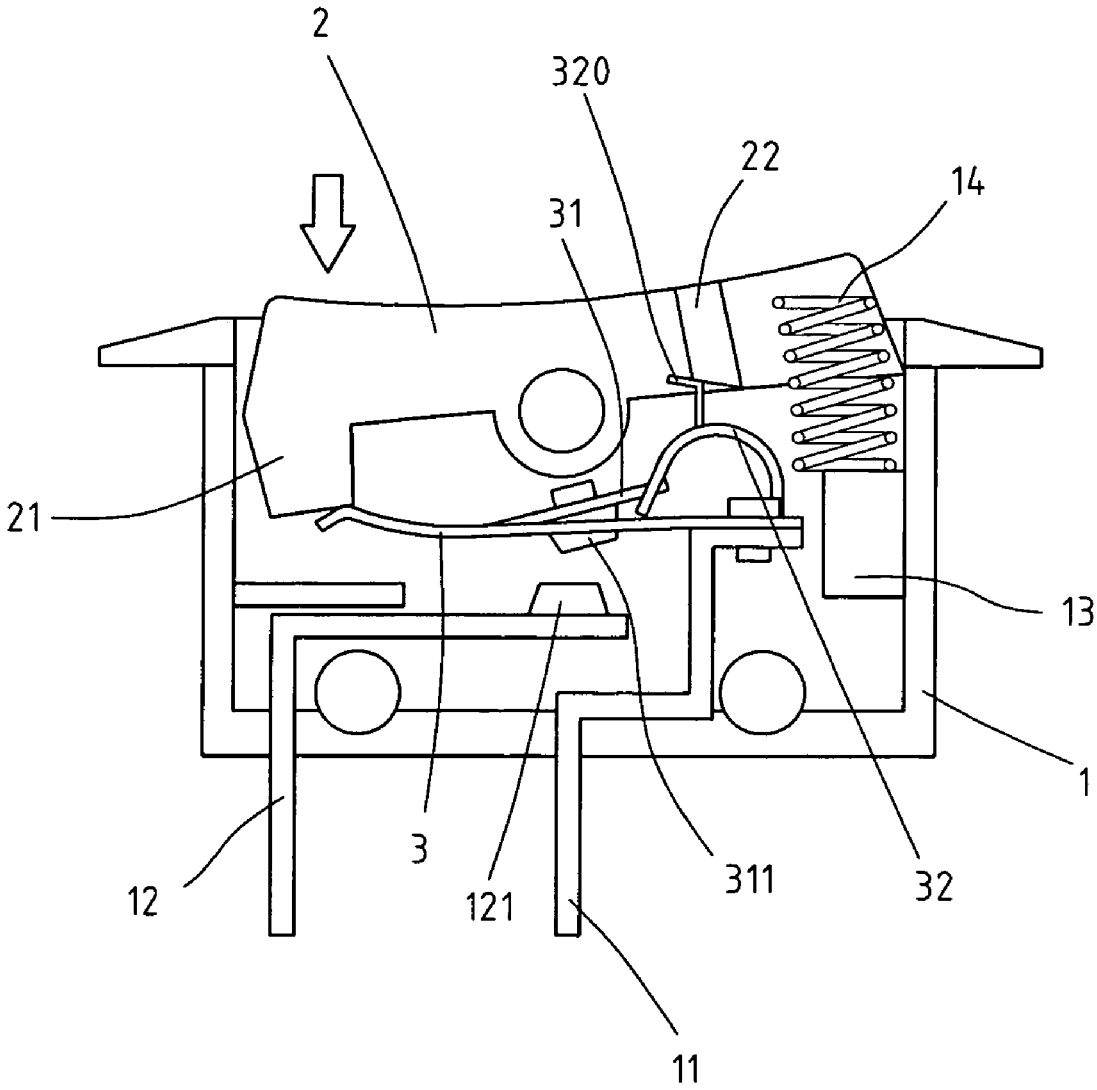
FIG. 1 is a side view to show the "OFF" status of the safety switch in accordance with the present invention.
Figure 2:
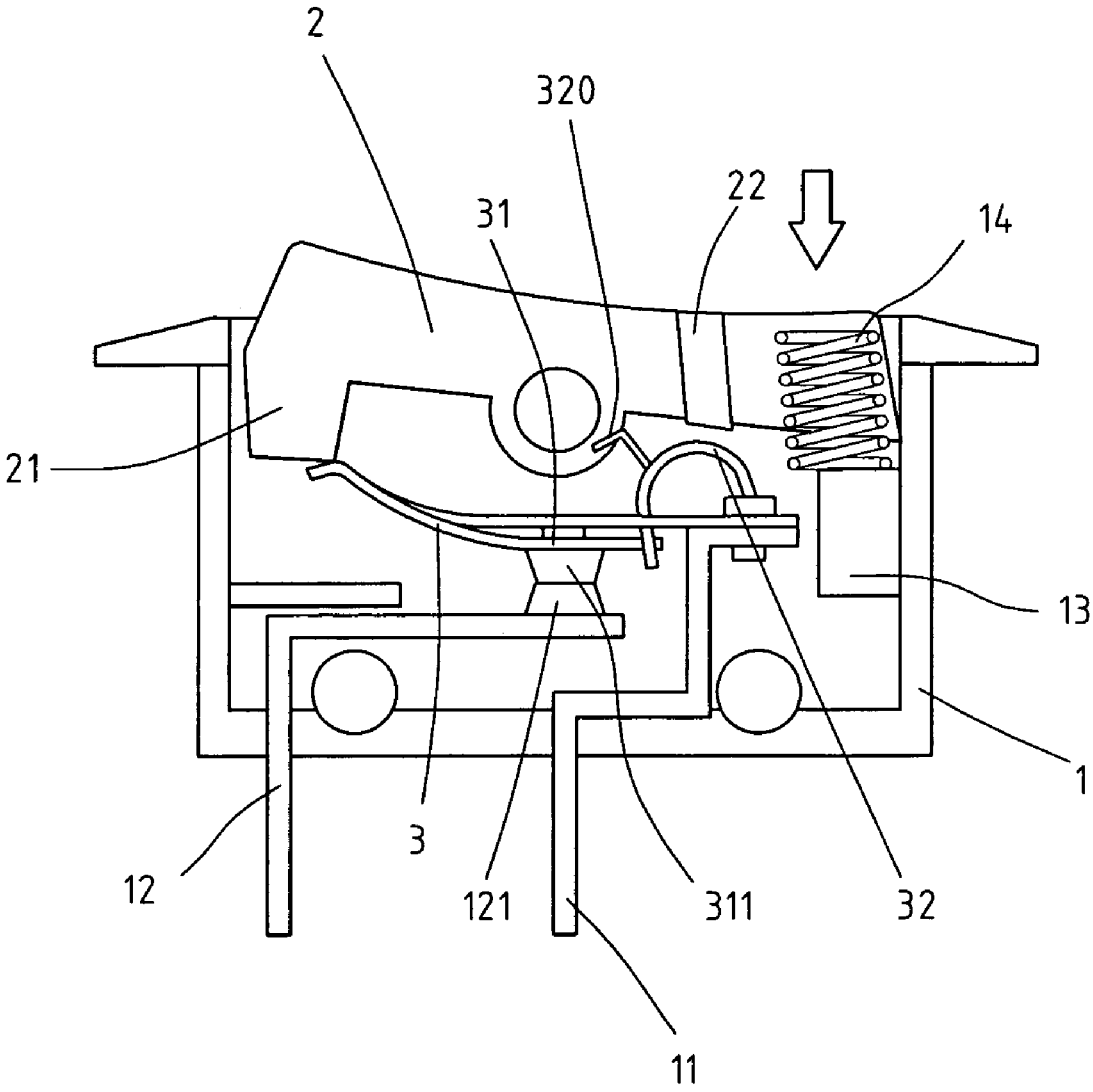
FIG. 2 is a side view to show the "ON" status of the safety switch in accordance with the present invention.
Figure 4:
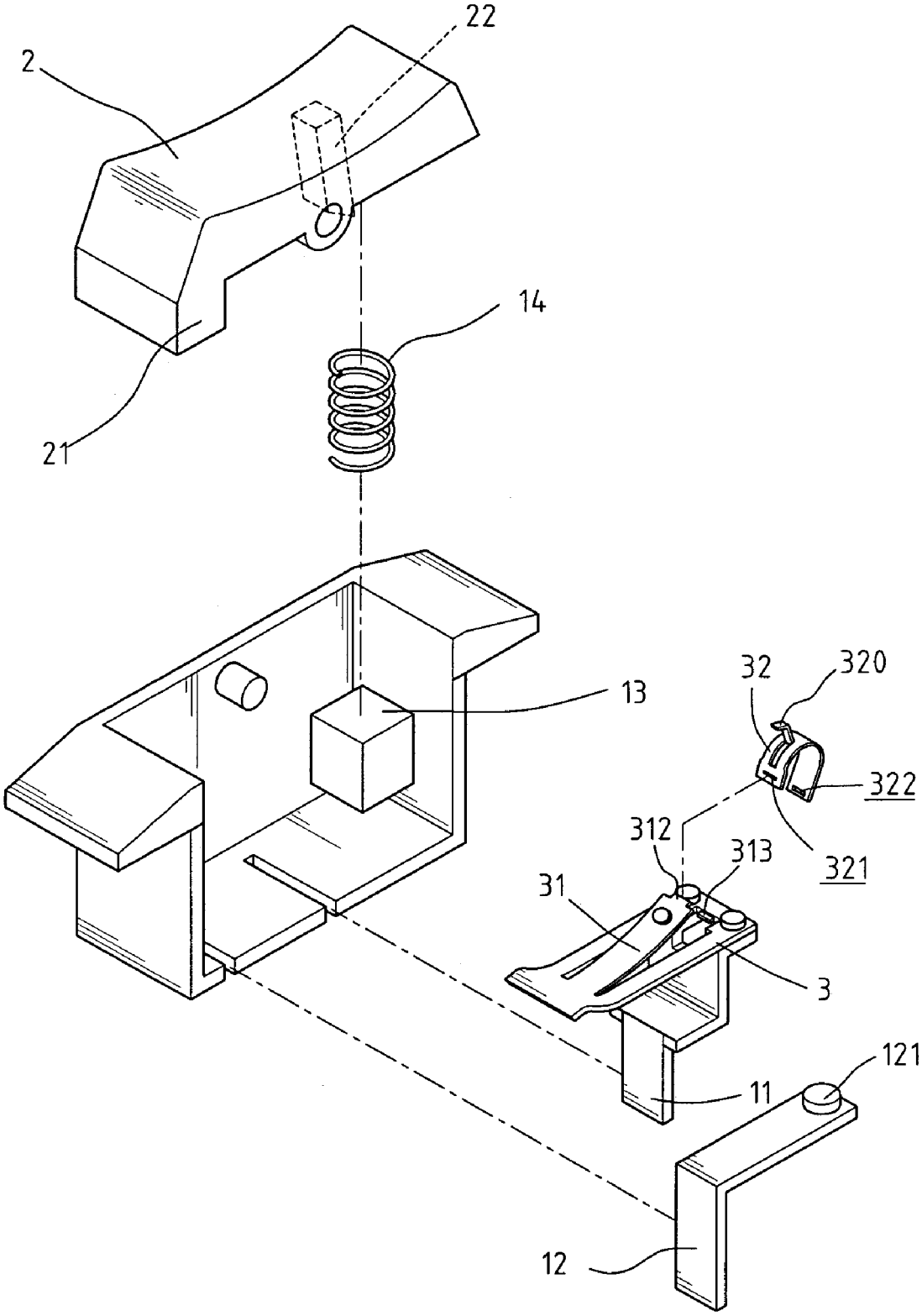
FIG. 4 is an exploded view of the safety switch in accordance with the present invention.

Referring to the drawings and in particular FIGS. 1, 2 and 4, a safety switch constructed in accordance with the present invention comprises a body 10 having a top opening and a switch member 2 pivotably engaged with the top opening of the body 10 by a pin so that the switch member 2 can be pivoted about the pin between "ON" and "OFF" positions. A first terminal 11 and a second terminal 12 extend through a bottom of the body 10 and a resilient member 14 such as a spring as disclosed is connected between a protrusion 13 extending from the inside of the body 10 and a first end of the switch member 2. The resilient member 14 provides an upward force to push the first end of the switch member 2 upward. The switch member 2 has an extension 21 extending from a second end of an underside thereof and a push member 22 extends from the first end of the underside of the switch member 2.

A contact plate 3 is a curve flexible bimetallic plate and has a first end fixed to the first terminal 11 and a second end of the contact plate 3 is a free end. A contact portion 31 splits from the contact plate 3 and a first contact point 311 is connected to an underside of the contact portion 31. A free end of the contact portion 31 is located above a top surface of the contact plate 3 and connected with a free first end of a spring member 32. The free end of the contact portion 31 has a tongue 312 and the free first end of the spring member 32 has a first slot 321 with which the tongue 312 is engaged. The second end of the spring member 32 has a second slot 322 and a ridge 313 extends from an inner periphery of an opening from which the contact plate splits, the ridge 313 is engaged with the second slot 322. The spring member 32 has an extension portion 320 extending from a top thereof and located beneath the push member 22 of the switch member 2. A second contact point 121 is connected to the second terminal 12 and located beneath the first contact point 311 on the contact portion 31. It is noted that the second end of the contact plate 3 and the free end of the contact portion 31 are deformed in opposite directions when being heated.

Figure 3:
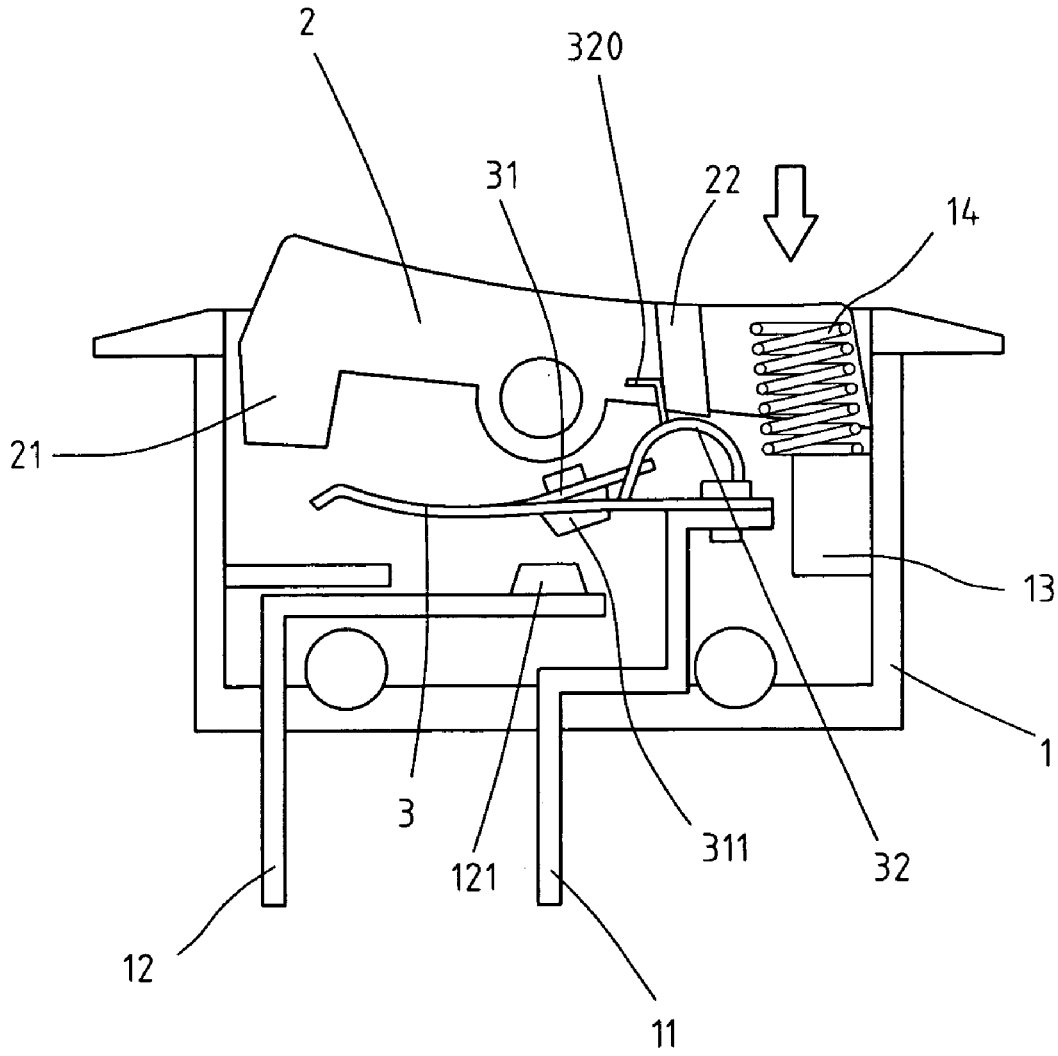
FIG. 3 shows the bimetallic plate is deformed downward and the contact portion is deformed upward to separate the two contact points.

When pushing the first end of the switch member 2 as shown in FIG. 2, the extension portion 320 of the push member 32 is pushed by the push member 22 so that the push member 22 is pivoted counter clockwise and lowers the contact portion 31 to contact the first and second contact points 311, 121. This is the "ON" position for the switch member 2. As shown in FIG. 1, when pushing the second end of the switch member 2, the free end of the contact plate 3 is pushed downward and the contact portion 31 is deformed upward to separate the first and second contact points 311, 121. This is the "OFF" position for the switch member 2. When overload when the switch member 2 is "ON" position as shown in FIG. 3, the free end of the contact plate 3 is deformed downward and the contact portion 31 is deformed upward to separate the first and second contact points 311, 121. Because there is nothing located above the extension portion 320 so that the extension portion 320 can be deformed upward freely to allows the contact plate 3 to be deformed completely to cut off the circuit. Once the free end of the contact plate 3 is removed from the extension 21 of the switch member 2, the resilient member 14 pivots the switch member 2 to "OFF" position.

While we have shown and described the embodiment in accordance with the present invention, it should be clear to those skilled in the art that further embodiments may be made without departing from the scope of the present invention.

What is claimed is:

1. A switch comprising:

a body with a top opening and a switch member pivotably engaged with the top opening of the body, a first terminal and a second terminal extending through a bottom of the body, a resilient member connected between an inside of the body and a first end of the switch member, the switch member having an extension extending from a second end of an underside thereof and a push member extending from the first end of the underside of the switch member;

a contact plate being a curve flexible metal plate and having a first end fixed to the first terminal and a second end of the contact plate being a free end, a contact portion split from the contact plate and a first contact point connected to an underside of the contact portion, a free end of the contact portion located above a top surface of the contact plate and connected with a free first end of a spring member, the spring member having an extension portion extending from a top thereof and a second end of the spring member connected to the contact plate, a second contact point connected to the second terminal and located beneath the first contact point on the contact portion, the second end of the contact plate and the free end of the contact portion being deformed in opposite directions when being heated, the extension of the switch member located above the second end of the contact plate and pressing the second end of the contact plate downward when the switch member is in "OFF" position, the push member of the switch member located above the extension portion of the contact portion and pushing the extension portion toward the contact portion when the switch member is in "ON" position.

2. The device as claimed in claim 1, wherein a protrusion extends from the inside of the body and the resilient member is connected between the protrusion and the switch member.

3. The device as claimed in claim 1, wherein the free end of the contact portion has a tongue and the free first end of the spring member has a first slot with which the tongue is engaged.

4. The device as claimed in claim 1, wherein the second end of the spring member has a second slot and a ridge extends from an inner periphery of an opening from which the contact plate splits, the ridge is engaged with the second slot.

5. The device as claimed in claim 1, wherein the spring member is a U-shaped member.

6. The device as claimed in claim 1, wherein the contact plate is a bimetallic plate.

* * * * *